US011583464B2

(12) United States Patent
Cho et al.

(10) Patent No.: US 11,583,464 B2
(45) Date of Patent: Feb. 21, 2023

(54) SENSOR DEVICE AND WALKING ASSIST DEVICE USING THE SENSOR DEVICE

(71) Applicant: Samsung Electronics Co., Ltd., Suwon-si (KR)

(72) Inventors: Joon-Kee Cho, Yongin-si (KR); Youn Baek Lee, Yongin-si (KR); Kyung-Rock Kim, Yongin-si (KR)

(73) Assignee: Samsung Electronics Co., Ltd., Gyeonggi-do (KR)

( * ) Notice: Subject to any disclaimer, the term of this patent is extended or adjusted under 35 U.S.C. 154(b) by 0 days.

(21) Appl. No.: 16/356,306

(22) Filed: Mar. 18, 2019

(65) Prior Publication Data

US 2019/0209415 A1 Jul. 11, 2019

Related U.S. Application Data

(62) Division of application No. 15/602,455, filed on May 23, 2017, now abandoned.

(30) Foreign Application Priority Data

Dec. 28, 2016 (KR) ..... 10-2016-0181263

(51) Int. Cl.
*A61G 5/14* (2006.01)
*A61H 1/02* (2006.01)
(Continued)

(52) U.S. Cl.
CPC ..... *A61H 3/00* (2013.01); *A61H 2201/1215* (2013.01); *A61H 2201/163* (2013.01);
(Continued)

(58) Field of Classification Search
CPC ..... A61H 3/00; A61H 2003/007; A61H 2201/5061; A61H 2201/1642;
(Continued)

(56) References Cited

U.S. PATENT DOCUMENTS 7,628,766 B1 * 12/2009 Kazerooni ..... A61F 5/00 601/5
7,857,774 B2 12/2010 Sankai
(Continued)

FOREIGN PATENT DOCUMENTS

CN 108114414 B * 4/2021 ..... A61H 1/0244
EP 2226053 A2 8/2010
(Continued)

OTHER PUBLICATIONS

U.S. Office Action dated Oct. 10, 2019 in U.S. Appl. No. 15/602,455.
(Continued)

*Primary Examiner* — Ann Schillinger
(74) *Attorney, Agent, or Firm* — Harness, Dickey & Pierce, P.L.C.

(57) ABSTRACT

Sensor devices closely attached to a body of a user, and walking assist devices such sensor devices may be provided. For example, a sensor device including a sensor configured to sense physical information of the user, and a support configured to provide an elastic force to the sensor such that the sensor closely attached to the body regardless pf a movement of the user, and enable the sensor to sense the physical information of the user with relative accuracy may be provided.

10 Claims, 12 Drawing Sheets

(51) Int. Cl.
*A61H 3/00* (2006.01)
*A61F 2/68* (2006.01)
*A61F 2/50* (2006.01)

(52) U.S. Cl.
CPC ..... *A61H 2201/165* (2013.01); *A61H 2201/1642* (2013.01); *A61H 2201/1676* (2013.01); *A61H 2201/5064* (2013.01); *A61H 2201/5071* (2013.01)

(58) Field of Classification Search
CPC ..... A61H 2201/5069; A61H 2201/14; A61H 2201/165; A61H 1/0262; A61H 2201/1652; A61H 2201/5007; A61H 2201/5058; A61H 2201/5064; A61H 2201/5071; A61H 1/0244; A61H 2201/5084; A61H 1/024; A61H 2201/5092; A61H 2201/5097; A61H 2201/1638; A61H 2201/1671; A61H 2201/1676; A61B 5/0022; A61B 5/112; A61B 5/7475; A61B 5/02438; A61B 5/1038; A61B 5/486; A61B 5/742; A61B 2562/0219; A61B 5/11; A61B 5/0024; A61B 5/1036; A61B 5/6802; A61B 5/681; A61B 5/02427; A61B 5/6843; A61B 5/6844; A61B 5/14552; A61B 5/16; A61B 5/222
See application file for complete search history.

(56) References Cited

U.S. PATENT DOCUMENTS 7,880,552 B2 2/2011 Yasuhara et al.
8,057,410 B2 * 11/2011 Angold ..... A61H 3/00 601/5
8,801,641 B2 * 8/2014 Kazerooni ..... A61H 1/0255 601/5
8,945,028 B2 * 2/2015 Kazerooni ..... A61H 3/00 601/5
9,351,900 B2 * 5/2016 Walsh ..... B25J 9/0006
9,554,960 B2 * 1/2017 Kamon ..... A61H 3/00
9,855,654 B2 * 1/2018 Yagi ..... B25J 9/0006
9,868,204 B2 * 1/2018 Seo ..... B25J 9/0006
10,265,196 B2 * 4/2019 Ha ..... B25J 9/0006
10,702,440 B2 * 7/2020 Kim ..... A61F 2/70
2007/0054777 A1 * 3/2007 Kawai ..... B25J 9/1638 482/1
2014/0330431 A1 * 11/2014 Hollander ..... B25J 9/0006 700/245
2015/0127018 A1 * 5/2015 Lim ..... A61H 1/0266 606/130
2015/0134080 A1 * 5/2015 Roh ..... B25J 9/1694 623/32
2015/0173993 A1 * 6/2015 Walsh ..... A61F 2/68 414/4
2015/0231018 A1 * 8/2015 Shim ..... A61H 1/024 623/24
2016/0022440 A1 1/2016 Ha et al.
2016/0106616 A1 4/2016 Kim et al.
2016/0107309 A1 * 4/2016 Walsh ..... A61H 1/024 248/550
2016/0206499 A1 * 7/2016 Shim ..... A61B 5/1038
2017/0027801 A1 * 2/2017 Choi ..... A61B 5/024
2017/0056274 A1 * 3/2017 Lee ..... A61F 5/0102
2017/0202724 A1 * 7/2017 De Rossi ..... A61F 5/0102
2018/0153722 A1 * 6/2018 Cromie ..... A61B 5/6812

FOREIGN PATENT DOCUMENTS

JP 4417300 B2 * 2/2010 ..... A61H 1/0237
JP 4426432 B2 * 3/2010 ..... A61F 5/0102
JP 2010110564 A 5/2010
JP 2013173190 A * 9/2013 ..... A61H 1/0244
JP 5344501 B2 11/2013
JP 5883256 B2 3/2016
KR 2019990009126 3/1999
KR 1020030086783 A 11/2003
KR 100615446 B1 8/2006
KR 101099521 B1 12/2011
KR 101350334 B1 1/2014
KR 101583871 B1 1/2016
KR 1020160018137 A 2/2016
WO WO-2007057899 A2 5/2007
WO WO-2014081074 A1 5/2014

OTHER PUBLICATIONS

U.S. Office Action dated Apr. 15, 2019 in U.S. Appl. No. 15/602,455.
"Development of Tight-fitting Upper Clothing for Measuring ECG—A Focus on Weft Reduction Rate and Subjective Assessment-", Journal of the Korean Society of Clothing and Textiles, Nov. 2012.
U.S. Office Action dated Sep. 14, 2020 issued in U.S. Appl. No. 15/602,455.
U.S. Office Action dated Mar. 23, 2021 issued in U.S. Appl. No. 15/602,455.
U.S. Office Action dated Nov. 30, 2021 issued in U.S. Appl. No. 15/602,455.

* cited by examiner

SENSOR DEVICE AND WALKING ASSIST DEVICE USING THE SENSOR DEVICE

CROSS-REFERENCE TO RELATED APPLICATION

This application is a divisional of U.S. application Ser. No. 15/602,455, filed May 23, 2017, which claims priority under 35 U.S.C. § 119 to Korean Patent Application No. 10-2016-0181263, filed on Dec. 28, 2016 in the Korean Intellectual Property Office, the entire contents of each of which are incorporated herein by reference.

BACKGROUND

1. Field

At least one example embodiment relates to a sensor device to sense physical information of a user, and more particularly, to a sensor device to be attached to a body of a user.

2. Description of the Related Art

A recent issue of aging societies has contributed to a growing number of people who experience inconvenience and pain from reduced muscular strength or joint problems due to aging. Thus, interest in a walking assist device that can enable an elderly user or a patient with reduced muscular strength or joint problems to walk with less effort is growing.

SUMMARY

Some example embodiments relate to sensor devices of walking assist devices to sense physical information of a user.

In some example embodiments, the sensor device may include a sensor configured to be attached to a body of the user, and a support configured to provide an elastic force to the sensor to attach the sensor to the body of the user.

The sensor device may further include a slider disposed between the sensor and the support, the slider configured to move the sensor translationally relative to the support. The slider may move along a first virtual axis.

The sensor device may further include a rotator between the sensor and the support, the rotator configured to move the sensor rotationally relative to the support. The rotator may rotate on a second virtual axis vertical to the first virtual axis.

The sensor may be an inertial measurement unit (IMU) configured to measure a posture of the body to which the sensor is attached.

The sensor may sense biodata of the body to which the sensor is attached.

The sensor device may be configured to calculate a gait cycle of the walking assist device using data sensed by the sensor.

The sensor device may be configured to provide the calculated gait cycle to cause the walking assist device to generate a torque to assist the user in walking based on the calculated gait cycle.

The support may include a pressure sensor configured to measure a pressure applied to the support. The measured pressure may be used to calculate a force to be transferred to the user.

The pressure sensor may be configured to measure the pressure using a load cell.

Other example embodiments relate to a walking assist device.

In some example embodiments, the walking assist device may include a sensor device including at least one sensor and a support, the at least one sensor attached to a body of a user and configured to sense physical information of the user, the support configured to provide an elastic force to the sensor to attach the sensor to the body of the user, a processor configured to calculate a gait cycle of the user based on the sensed physical information, and calculate a torque corresponding to the calculated gait cycle, and a driver configured to output the torque based on the calculated torque The sensor device may further include a slider between the sensor and the support, the slider configured to move the sensor translationally relative to the support.

The sensor device may further include a rotator between the sensor and the support, the rotator configured to move the sensor rotationally relative to the support.

The sensor may be an IMU configured to measure a posture of the body to which the sensor is attached.

The sensor may sense biodata of the body to which the sensor is attached.

The processor may be further configured to model the posture of the user based on the physical information, and calculate the gait cycle based on the modeled posture.

The at least one sensor may include a pressure sensor, the pressure sensor is configured to measure a pressure applied to the body by the torque output by the driving device, and the processor may be further configured to calculate a torque adjustment value based on the calculated gait cycle and the measured pressure, and adjust the torque based on the calculated torque adjustment value.

The support may further include a pressure sensor configured to measure a pressure applied to the body by the torque output by the driving device using a load cell.

Additional aspects of example embodiments will be set forth in part in the description which follows and, in part, will be apparent from the description, or may be learned by practice of the disclosure.

BRIEF DESCRIPTION OF THE DRAWINGS

These and/or other aspects will become apparent and more readily appreciated from the following description of example embodiments, taken in conjunction with the accompanying drawings of which.

DETAILED DESCRIPTION

Figure 1:
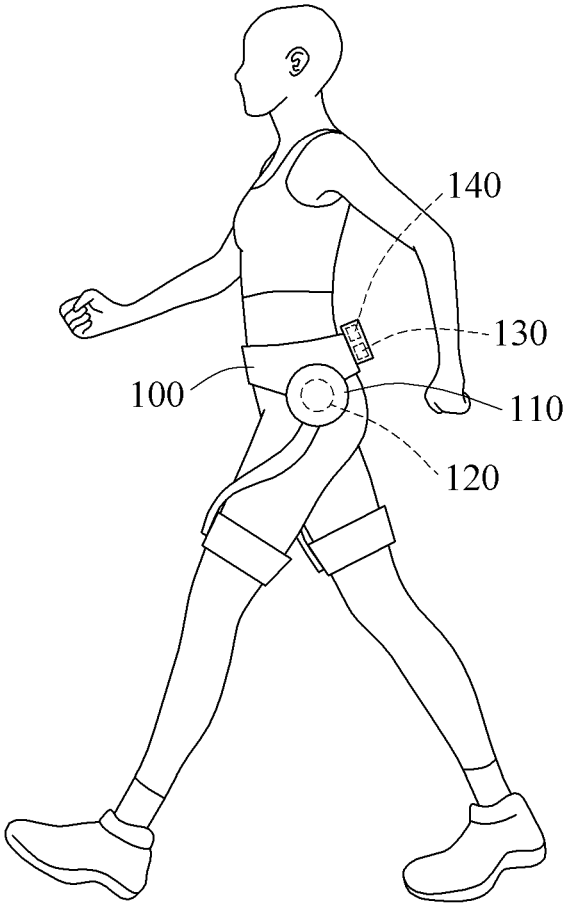
FIGS. 1 and 2 illustrate an example of a walking assist device according to at least one example embodiment.

Hereinafter, some example embodiments will be described in detail with reference to the accompanying drawings. Regarding the reference numerals assigned to the elements in the drawings, it should be noted that the same elements will be designated by the same reference numerals, wherever possible, even though they are shown in different drawings. Also, in the description of the example embodiments, detailed description of well-known related structures or functions may be omitted.

It should be understood that there is no intent to limit this disclosure to the particular example embodiments disclosed. On the contrary, the example embodiments are to cover all modifications, equivalents, and alternatives falling within the scope of the example embodiments. Like numbers refer to like elements throughout the description of the figures.

In addition, terms such as first, second, A, B, (a), (b), and the like may be used herein to describe components. Each of these terminologies is not used to define an essence, order or sequence of a corresponding component but used merely to distinguish the corresponding component from other component(s). It should be noted that if it is described in the specification that one component is "connected", "coupled", or "joined" to another component, a third component may be "connected", "coupled", and "joined" between the first and second components, although the first component may be directly connected, coupled or joined to the second component.

The terminology used herein is for the purpose of describing particular example embodiments only and is not intended to be limiting. As used herein, the singular forms "a," "an," and "the," are intended to include the plural forms as well, unless the context clearly indicates otherwise. It will be further understood that the terms "comprises," "comprising," "includes," and/or "including," when used herein, specify the presence of stated features, integers, steps, operations, elements, and/or components, but do not preclude the presence or addition of one or more other features, integers, steps, operations, elements, components, and/or groups thereof.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

Unless otherwise defined, all terms, including technical and scientific terms, used herein have the same meaning as commonly understood by one of ordinary skill in the art to which this disclosure pertains based on an understanding of the present disclosure. Terms, such as those defined in commonly used dictionaries, are to be interpreted as having a meaning that is consistent with their meaning in the context of the relevant art and the present disclosure, and are not to be interpreted in an idealized or overly formal sense unless expressly so defined herein.

Various example embodiments will now be described more fully with reference to the accompanying drawings in which some example embodiments are shown. In the drawings, the thicknesses of layers and regions are exaggerated for clarity.

<Outline of Walking Assist Device>

Figure 2:
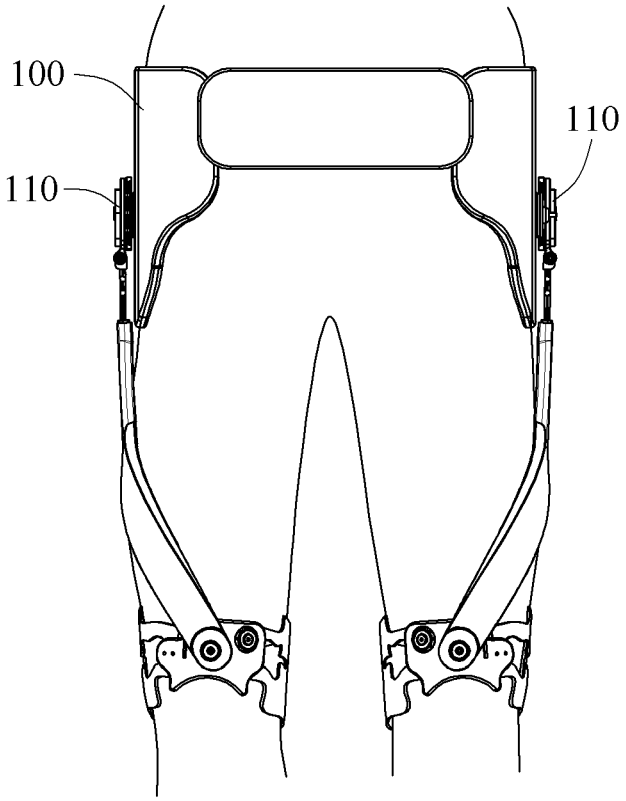

FIGS. 1 and 2 illustrate an example of a walking assist device according to at least one example embodiment.

Referring to FIG. 1, a walking assist device 100 may be worn on a user to assist the user in walking. The walking assist device 100 may be a wearable device.

Although FIG. 1 illustrates a hip-type walking assist device, a type of a walking assist device is not limited to the illustrated hip-type walking assist device, and the walking assist device may be of a type that supports an entire lower limb or supports a portion of the lower limb. The walking assist device may be any one of a type supporting a portion of a lower limb, a type supporting a knee, a type supporting an ankle, and a type supporting an entire body.

Some example embodiments to be described hereinafter with reference to the accompanying drawings including FIG. 1 relate to the hip-type walking assist device, but example embodiments are not limited thereto. Example embodiments may relate to any device that assists a user in walking.

Referring to FIG. 1, the walking assist device 100 may include at least one driver (or alternatively referred to as a driving device) 110, a sensor device120, an inertial measurement unit (IMU) 130, and a controller 140.

The at least one driver 110 may drive a hip joint of the user. For example, the at least one driver 110 may be disposed on a right hip portion and/or a left hip portion of the user.

The at least one driver 110 may include a motor that generates a rotational torque.

The sensor device 120 may sense an angle of the hip joint of the user when the user walks. Information on the angle of the hip joint to be sensed by the sensor device 120 may include an angle of a right hip joint, an angle of a left hip joint, a difference between the angles of both hip joints, and a motion direction of the hip joint. For example, the sensor device 120 may be disposed in the at least one driver 110.

The sensor device 120 may include a potentiometer. The potentiometer may sense an R-axis joint angle, an L-axis joint angle, an R-axis joint angular velocity, and an L-axis joint angular velocity with respect to a walking motion of the user. The terms "sense" and "measure" may be interchangeably used herein.

The IMU 130 may measure acceleration information and posture information while the user is walking. For example, the IMU 130 may measure an X-axis acceleration, a Y-axis acceleration, a Z-axis acceleration, an X-axis angular velocity, a Y-axis angular velocity, and a Z-axis angular velocity with respect to the walking motion of the user.

The walking assist device 100 may detect a point at which a foot of the user lands based on the acceleration information measured by the IMU 130.

In addition to the sensor device 120 and the IMU 130, the walking assist device 100 may include another sensor, for example, an electromyogram (EMG) sensor, which is configured to sense a change in a bio-signal or a momentum of the user with respect to the walking motion of the user.

The controller 140 may control the at least driver 110 to output an assistance force to assist the user in walking. For example, in a case of a hip-type walking assist device, the at least one driver 110 may include two drivers associated with a left hip and a portion for a right hip, respectively, and the controller 140 may output a control signal or control signals to control the two drivers to generate respective torques.

The controller 140 may include at least one processor and a memory.

The processor may be a data processing device embodied by hardware including a circuitry having a physical structure to execute desired operations. The operations may include, for example, codes and instructions included in a program. The data processing device embodied by hardware may include, for example, a microprocessor, a central processing unit (CPU), a processor core, a multi-core processor, a multiprocessor, an application-specific integrated circuit (ASIC), and a field programmable gate array (FPGA).

The memory may store data processed by the processor. The memory may store the program. The program to be stored in the memory may be a set of syntaxes that may be coded and executed by the processor to calculate and output a torque. The memory may include, for example, at least one of volatile memory (e.g., random access memory (RAM)), nonvolatile memory (e.g., flash memory), hard disk, and optical disk.

The at least one driver 110 may generate a torque based on the control signal output from the controller 140. In some example embodiments, the walking assist device 100 may include a driver for a right leg and a driver for a left leg. For example, the controller 140 may be designed to control one of the drivers. In such an example, when the controller 140 is configured to control one of the drivers, another controller may be provided to control the other one of the drivers. In some example, one controller 140 may be configured to control both of the drivers.

When the user wearing the walking assist device 100 moves, a gap between a main frame of the walking assist device 100 and the body of the user may be generated. Due to the gap between the main frame of the walking assist device 100 and the body of the user, a sensor configured to sense data of the user may not sense the data correctly. In a case that the IMU 130 is provided in the main frame corresponding to a waist of the user, a gap between the main frame and the waist of the user may be generated when the user bends down. Thus, a correct inclination of an upper body of the user may not be sensed.

When a posture of the user is not accurately measured, a gait cycle to be calculated based on the posture of the user may not be correct, and a torque to be calculated based on the gait cycle may also not be correct. In a case that a torque not suited to an actual gait cycle is provided, the user may experience inconvenience, or even a dangerous situation may occur. The gait cycle used herein refers to a degree of walking progression indicating movements of legs to walk, and may include a stance period of walking and a swing period of walking. For example, the gait cycle may start from a point in time at which a heel of a foot touches the ground, and end with a point in time immediately before the heel touches the ground again.

Hereinafter, a sensor device to be closely attached to a body of a user and a method to be performed by a walking assist device to output a torque using the sensor device will be described in detail with reference to FIGS. 3 through 10.

Figure 3:
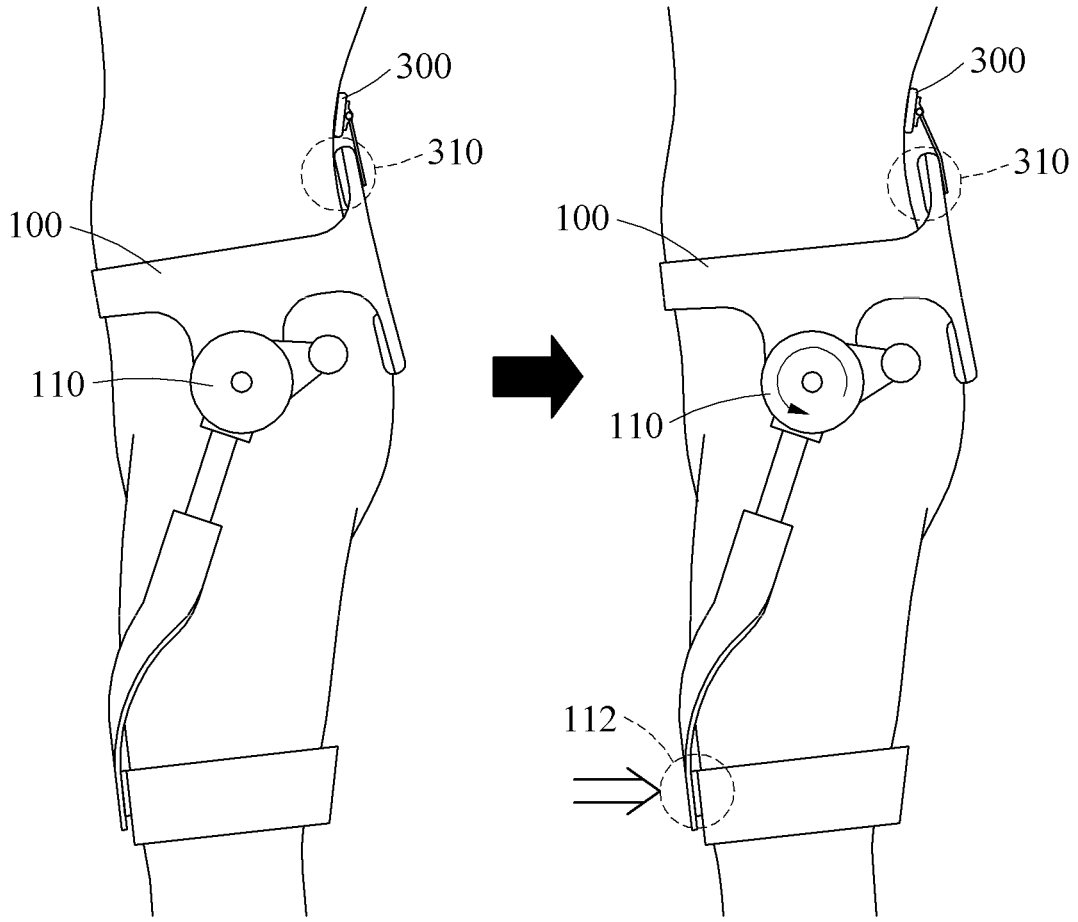
FIG. 3 illustrates an example of a sensor device closely attached to a body of a user according to at least one example embodiment.

FIG. 3 illustrates an example of a sensor device closely attached to a body of a user according to at least one example embodiment.

Referring to FIG. 3, when a user remains stationary as illustrated in a left portion of FIG. 3, a gap 310 between a waist portion of a main frame of a walking assist device 100 and a waist of the user may not be generated, or be relatively small. In contrast, when the user moves as illustrated in a right portion of FIG. 3, the gap 310 between the waist portion of the main frame of the walking assist device 100 and the waist of the user may be generated. For example, when the user moves, a frame 112 connected to a driver 110 may apply a force to a leg of the user. When a motor of the driver 110 rotates, such a rotation may apply a force to the frame 112. The main frame may then be deformed by a reaction of the force applied to the frame 112, and such a deformation of the main frame may generate the gap 310 between the waist portion of the main frame and the waist of the user.

When a sensor device 300 is closely attached to the waist of the user, although the gap 310 between the waist portion of the main frame and the waist of the user is generated, a posture of the user may be sensed accurately. Hereinafter, a structure of a sensor device that configured to be closely attached to a body of a user will be described in detail with reference to FIGS. 4 and 5.

Figure 4:
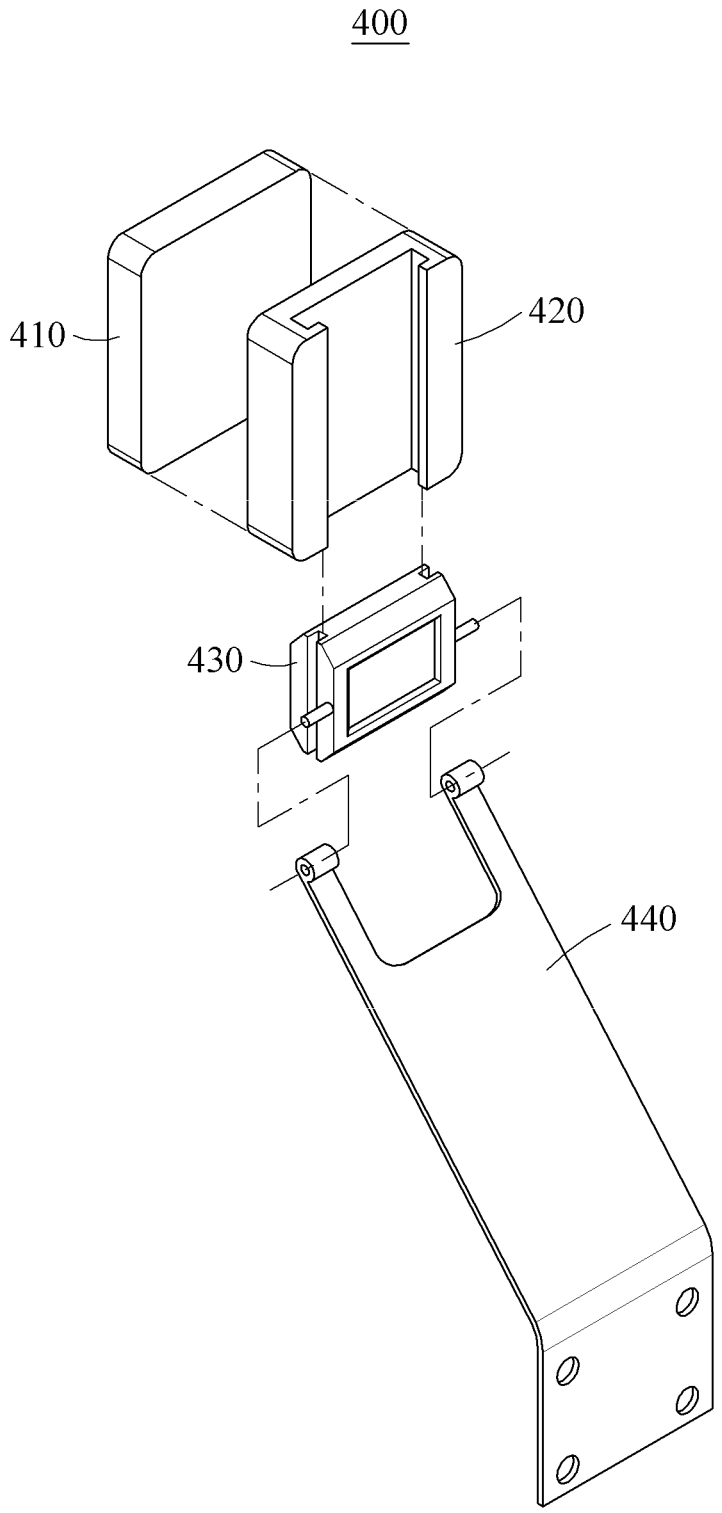
FIGS. 4 and 5 illustrate an example of a sensor device according to at least one example embodiment.
Figure 5:
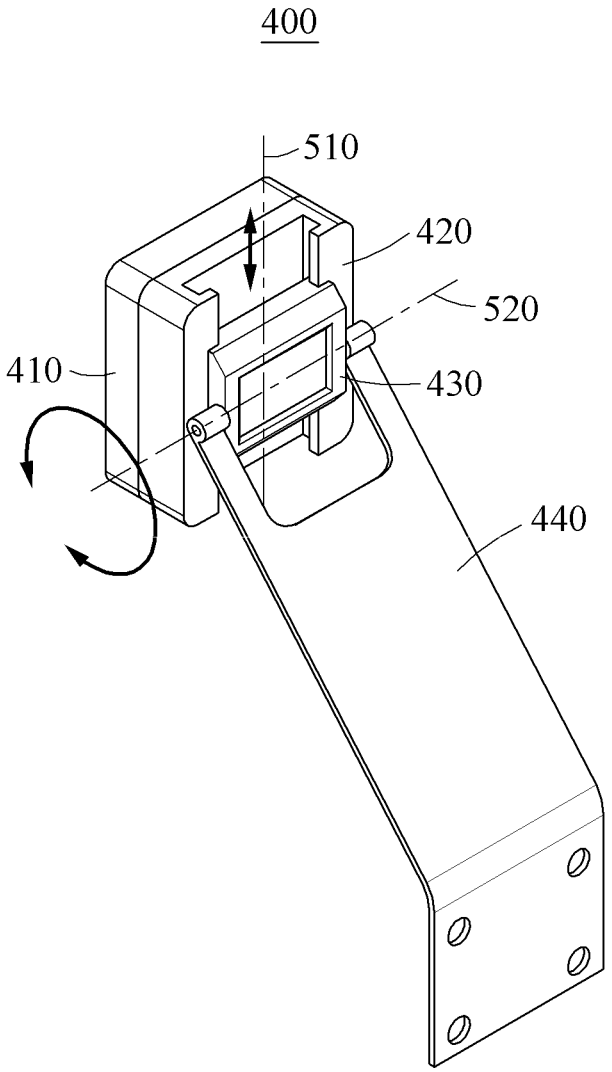

FIGS. 4 and 5 illustrate an example of a sensor device according to at least one example embodiment.

Referring to FIG. 4, a sensor device 400 includes a sensor 410, a slider 420, a rotator 430, and a support 440.

The sensor 410 may sense physical information of a user. For example, in a case of the sensor 410 being an IMU, the sensor 410 may measure a posture of a body of the user to which the sensor 410 is attached. In a case that the sensor 410 is attached to a waist of the user, the sensor 410 may sense a posture of an upper body of the user. In some example embodiments, the sensor 410 may additionally sense biodata of the body of the user. The biodata may include, for example, heart rates and EMG.

The slider 420 may be disposed between the sensor 410 and the support 440 such that the sensor 410 may move translationally relative to the support 440. Although FIGS. 4 and 5 illustrate the rotator 430 being present between the slider 420 and the support 440, the rotator 430 may be omitted according some example embodiments.

The rotator 430 may be disposed between the sensor 410 and the support 440 such that the sensor 410 may move rotationally relative to the support 440. Although FIGS. 4 and 5 illustrate the slider 420 being present between the sensor 410 and the rotator 430, the slider 420 may be omitted according to some example embodiments.

One side of the support 440 may be connected to a main frame of a walking assist device 100, and the support 440 may provide an elastic force to the sensor 410 such that the sensor 410 may be closely attached to the body of the user. A material of the support 440 may have a resiliency to return an original form when an external force is applied to the support 440. The support 440 may be, for example, a leaf spring. Due to such an elastic force provided by the support 440 to the sensor 410, the sensor 410 may be closely attached to the body of the user although a gap between the main frame and the body of the user is generated. Although FIGS. 4 and 5 illustrate the slider 420 and the rotator 430 being present between the sensor 410 and the support 440, the slider 420 and the rotator 430 may be omitted according to some example embodiments.

FIG. 5 illustrates a movement of the sensor 410 by the slider 420 and a movement of the sensor 410 by the rotator 430.

Referring to FIG. 5, the slider 420 may move along a first virtual axis 510. The slider 420 may include a furrow for a translation motion, and the first virtual axis 510 may be formed along the furrow.

The rotator 430 may rotate on a second virtual axis 520. The second virtual axis 520 may be vertical to the first vertical axis 510. When the rotator 430 rotates, the slider 420 and the sensor 410 that are connected to the rotator 430 may rotate together.

Thus, although the body to which the sensor 410 is attached moves, the sensor 410 may be closely attached to the body using the slider 420 and the rotator 430.

Figure 6:
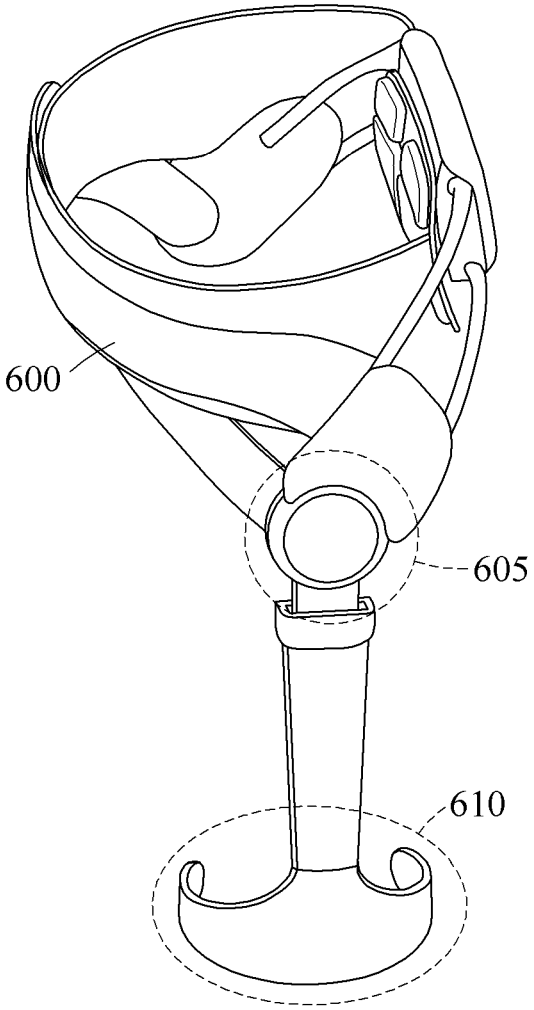
FIGS. 6 and 7 illustrate another example of a walking assist device according to at least one example embodiment.
Figure 7:
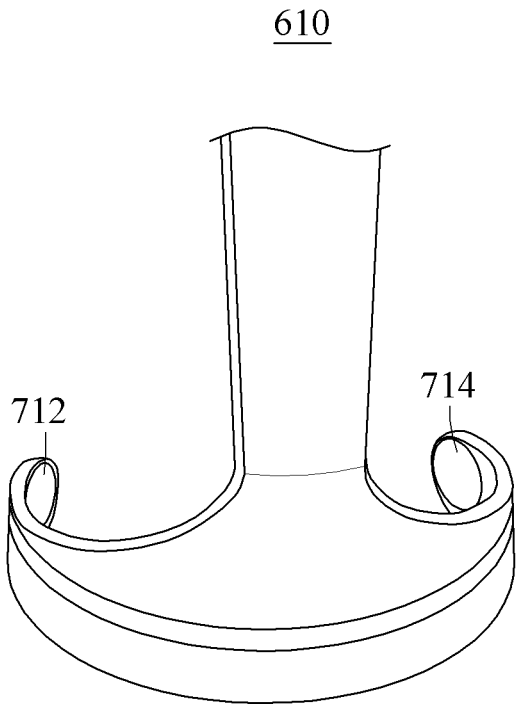

FIGS. 6 and 7 illustrate another example of a walking assist device according to at least one example embodiment.

A walking assist device 600 illustrated in FIG. 6 is of a hip-type. Dissimilar to the walking assist device 100 described with reference to FIGS. 1 and 2, a frame 610 connected to a driver 605 of the walking assist device 600 is of an open type. In a case of the frame 610 being of the open type, wearability of the walking assist device 600 may be improved so that a user may wear the walking assist device 600 more conveniently. However, in such cases, the frame 610 may not be closely attached to a body of the user, and thus a torque output by the driver 605 may not be correctly or accurately transferred to the body.

In such a case that the output torque is not correctly or accurately transferred to the body, an assistance force to assist the user in walking may be insufficient. The walking assist device 600 may calculate the insufficient assistance force, and increase a torque to supplement the insufficient assistance force. Referring to FIG. 7, the walking assist device 600 may indirectly calculate an assistance force to be transferred to the body using a sensor device provided on at least one of a first side 712 or a second side 714 of the frame 610. The first side 712 and the second side 714 may be a point of action at which the torque is to be transferred to the body.

The sensor device used to calculate an assistance force to be transferred to a body of a user will be described in greater detail with reference to FIGS. 8 through 10.

Figure 8:
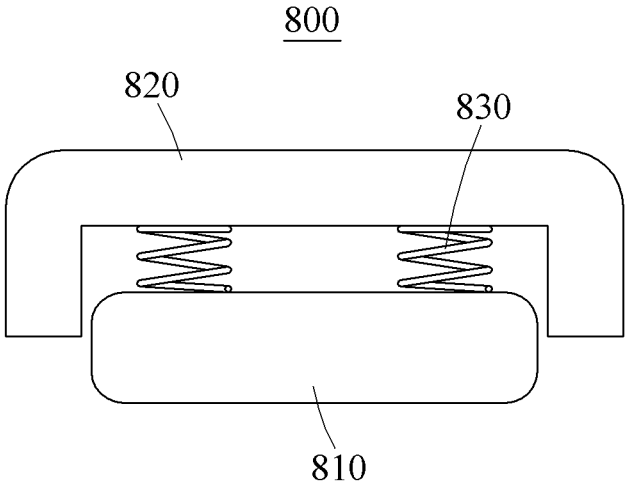
FIG. 8 illustrates another example of a sensor device according to at least one example embodiment.

FIG. 8 illustrates another example of a sensor device according to at least one example embodiment.

Referring to FIG. 8, a sensor device 800 may be attached to at least one of the first side 712 or the second side 714 described above with reference to FIG. 7. The sensor device 800 may include a sensor 810, a support 830, and a connector 820.

For example, the sensor 810 may be the sensor 410 described above with reference to FIGS. 4 and 5. In a case of the sensor 810 being an IMU, the sensor 810 may measure a posture of a leg of a user. The measured posture of the leg may be used to calculate a gait cycle of the user. For another example, the sensor 810 may be an EMG sensor.

The support 830 may provide an elastic force to the sensor 810 such that the sensor 810 may be closely attached to a body of the user. A material of the support 830 may have a resiliency to return an original form when an external force is applied to the support 830. For example, the support 830 may be a spring. For another example, the support 830 may be a leaf spring. Due to such an elastic force provided by the support 830 to the sensor 810, the sensor 810 may be closely attached to the body of the user although a gap between the frame 610 and the body of the user is generated. In other example embodiments, the support 830 may include a sensor configured to measure a pressure applied to the support 830. In such case, the support 830 may measure the pressure applied to the support 830 using a load cell.

The connector 820 may connect the sensor 810 and the frame 610.

A method of measuring an assistance force to be transferred to a body of a user using the sensor device 800 will be described in greater detail with reference to FIGS. 9 and 10.

Figure 9:
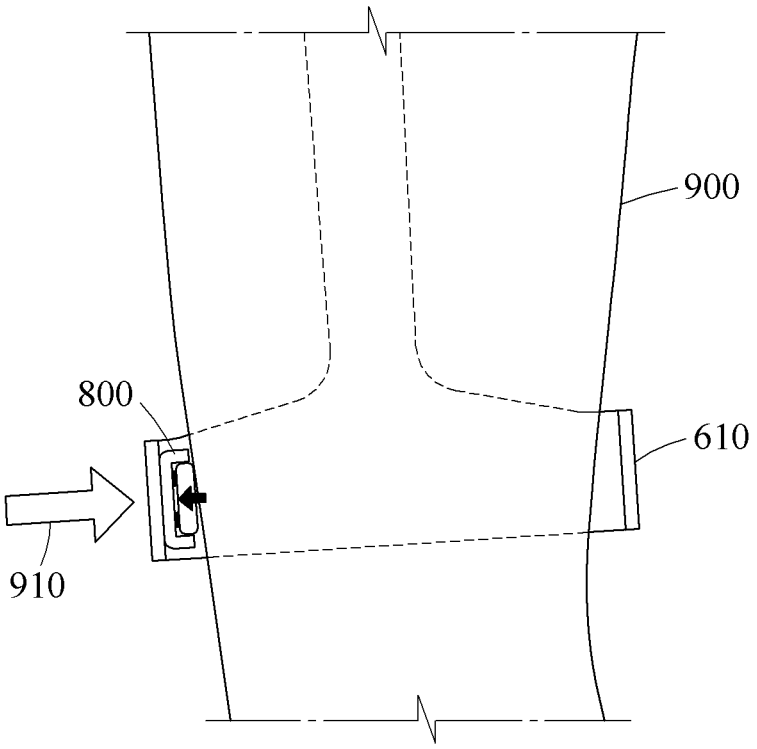
FIGS. 9 and 10 illustrate an example of a method of measuring a pressure using a sensor device according to at least one example embodiment.
Figure 10:
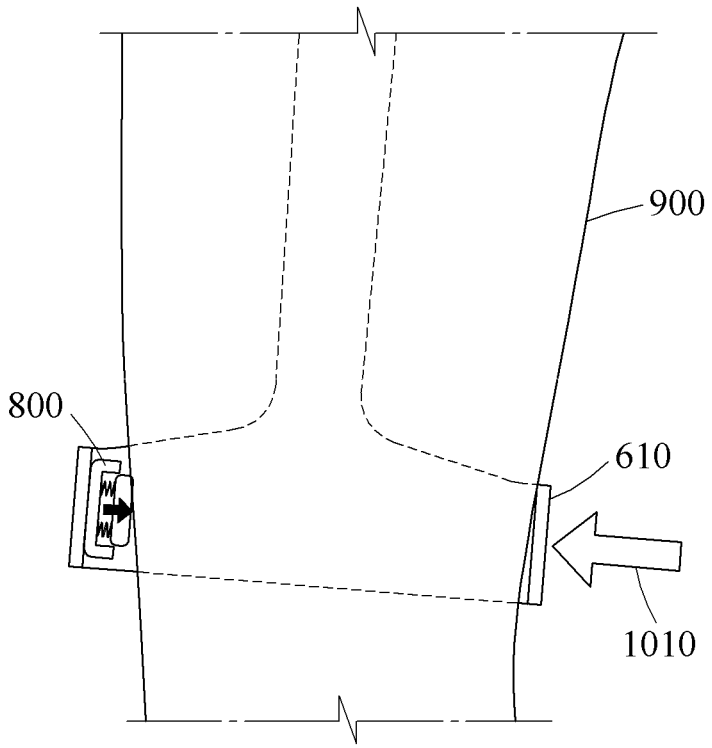

FIGS. 9 and 10 illustrate an example of a method of measuring a pressure using a sensor device according to at least one example embodiment.

Referring to FIG. 9, in a case that a portion of a body of a user to which the sensor device 800 is to be attached is a thigh 900 and the sensor device 800 is attached to a front side of the thigh 900, a pressure may be applied to the sensor device 800 when a force 910 is applied from the front side of the thigh 900. The sensor device 800 may measure the applied pressure. Referring to FIG. 10, when a force 1010 is applied from a rear side of the thigh 900, the support 830 of the sensor device 800 may provide an elastic force to the sensor 810, and the sensor 810 may thus be closely attached to the thigh 900. When the sensor 810 is closely attached to the thigh 900, the sensor 810 may sense physical information of the user although a gap between the frame 610 and the thigh 900 is generated.

In some example embodiments, the sensor device 800 may include a plurality of sensors. For example, the sensor device 800 may include at least one of an EMG sensor or an IMU. A pressure measured by the support 830 of the sensor device 800 may be used to calculate an assistance force transferred to the body. Posture information sensed by the IMU may be used to calculate a gait cycle of the user.

Figure 11:
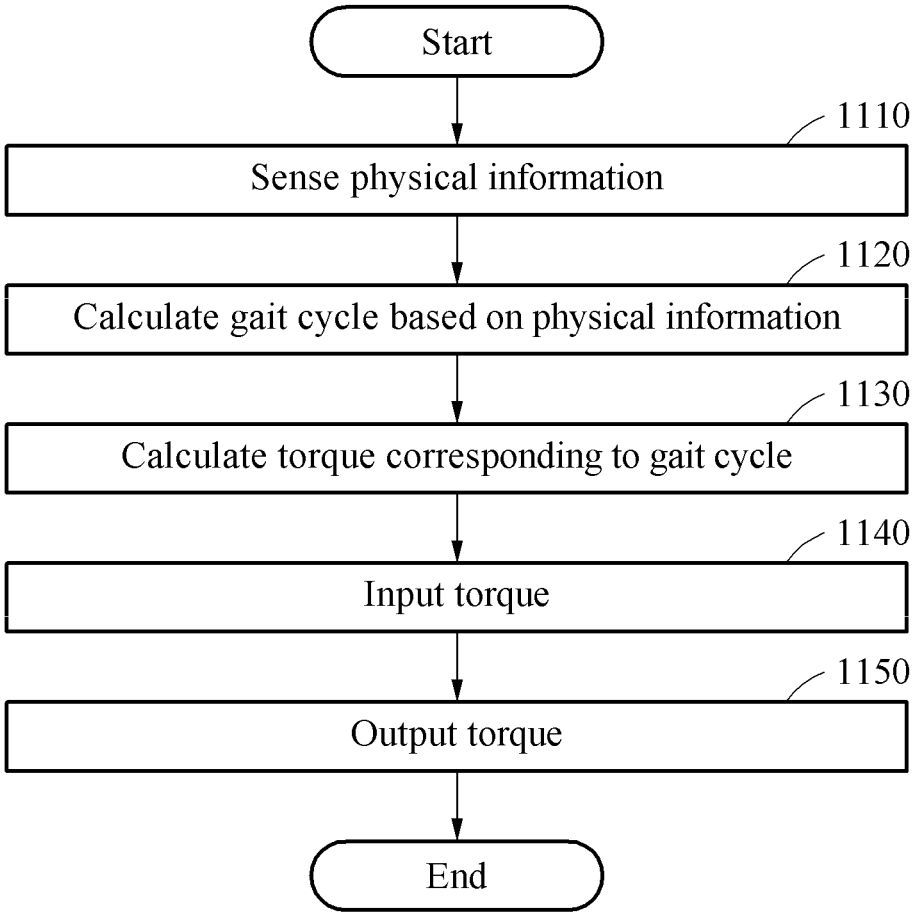
FIG. 11 is a flowchart illustrating an example of a method of providing an assistance force to a user according to at least one example embodiment.

FIG. 11 is a flowchart illustrating an example of a method of providing an assistance force to a user according to at least one example embodiment.

Operations 1110 through 1150 to be described hereinafter with reference to FIG. 11 may be performed by the walking assist device 100 described above with reference to FIGS. 1 through 5, or the walking assist device 600 described above with reference to FIGS. 6 through 9.

Referring to FIG. 11, in operation 1110, a sensor device senses physical information of a user using a sensor. The sensor device described herein may be the sensor device 400 described above with reference to FIG. 4, or the sensor device 800 described above with reference to FIG. 8. The physical information may include at least one of posture information on a posture of a body of the user to which the sensor is attached or bio-information of the user.

In operation 1120, a processor calculates a gait cycle based on the sensed physical information. The processor described herein may be included in the controller 140 described above with reference to FIGS. 1 and 2. For example, the processor may determine which period of the gait cycle the sensed physical information corresponds to. The physical information may be sensed by at least one of an EMG sensor or an IMU. In a case that the EMG sensor or the IMU is closely attached to the body, more accurate physical information may be obtained. For example, the EMG sensor and the IMU may be the sensor 410 described above with reference to FIG. 5. The physical information corresponding to the entire gait cycle and each period of the gait cycle may be mapped in advance.

The processor may model a posture of the user based on the physical information. The processor may obtain the physical information of the user using a plurality of sensor devices. For example, when the sensor device senses an angle of an upper body of the user, an angle of a left hip joint, and an angle of a right hip joint, the processor may model a current posture of the user based on the sensed physical information. The processor may calculate the gait cycle based on the modeled posture.

In operation 1130, the processor calculates a torque corresponding to the calculated gait cycle. The torque may generate an assistance force to assist the user in walking. A torque profile associated with each period of the gait cycle may be stored in advance. The processor may determine the torque corresponding to the calculated gait cycle using the torque profile.

In operation 1140, the processor inputs the calculated torque to a driver. The driver described herein may be the driver 110 described above with reference to FIGS. 1 and 2, or the driver 605 described above with reference to FIG. 6. For example, the processor may input a current or a voltage corresponding to the torque to the driver.

In operation 1150, the driver outputs the torque. For example, the driver may output a rotational torque using a motor.

Figure 12:
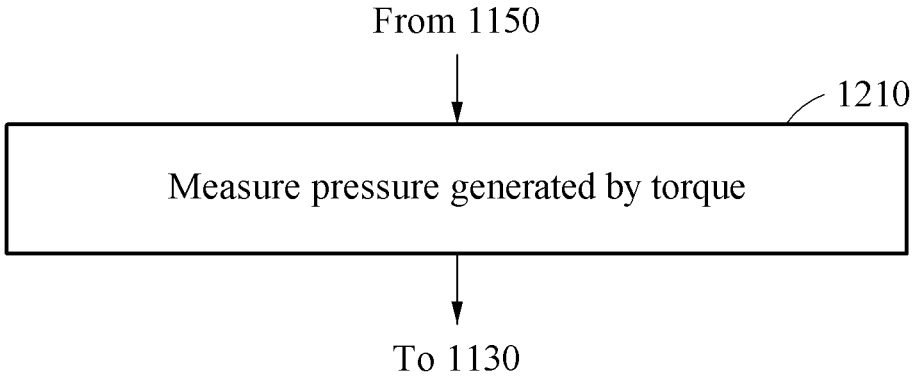
FIG. 12 is a flowchart illustrating an example of a method of calculating a torque based on a pressure generated by the torque according to at least one example embodiment.

FIG. 12 is a flowchart illustrating an example of a method of calculating a torque based on a pressure generated by a torque according to at least one example embodiment.

Subsequent to operation 1150 described above with reference to FIG. 11, operation 1210 to be described hereinafter may be performed.

Referring to FIG. 12, in operation 1210, a sensor device may measure a pressure of a body generated by a torque. For example, the pressure of the body may be measured by the sensor device attached to a point of action of the body on which the torque acts. The sensor device described herein may be the sensor device 800 described above with reference to FIG. 8. The support 830 of the sensor device 800 may include a sensor configured to measure a pressure applied to the support 830. For example, the support 830 may include a load cell.

The measured pressure may be fed back to operation 1130 described above with reference to FIG. 11. In operation 1130, the processor calculates a torque based on the current gait cycle and the received pressure. For example, the processor may calculate an assistance force or power actually transferred to a user, and calculate a difference between the transferred assistance force and a desired assistance force. The processor may increase or decrease a torque corresponding to the current gait cycle based on the calculated difference.

The units and/or modules described herein may be implemented using hardware components and software components. For example, the hardware components may include microphones, amplifiers, band-pass filters, audio to digital convertors, and processing devices. A processing device may be implemented using one or more hardware device configured to carry out and/or execute program code by performing arithmetical, logical, and input/output operations. The processing device(s) may include a processor, a controller and an arithmetic logic unit, a digital signal processor, a microcomputer, a field programmable array, a programmable logic unit, a microprocessor or any other device capable of responding to and executing instructions in a defined manner. The processing device may run an operating system (OS) and one or more software applications that run on the OS. The processing device also may access, store, manipulate, process, and create data in response to execution of the software. For purpose of simplicity, the description of a processing device is used as singular; however, one skilled in the art will appreciated that a processing device may include multiple processing elements and multiple types of processing elements. For example, a processing device may include multiple processors or a processor and a controller. In addition, different processing configurations are possible, such a parallel processors.

The software may include a computer program, a piece of code, an instruction, or some combination thereof, to independently or collectively instruct and/or configure the processing device to operate as desired, thereby transforming the processing device into a special purpose processor. Software and data may be embodied permanently or temporarily in any type of machine, component, physical or virtual equipment, computer storage medium or device, or in a propagated signal wave capable of providing instructions or data to or being interpreted by the processing device. The software also may be distributed over network coupled computer systems so that the software is stored and executed in a distributed fashion. The software and data may be stored by one or more non-transitory computer readable recording mediums.

The methods according to the above-described example embodiments may be recorded in non-transitory computer-readable media including program instructions to implement various operations of the above-described example embodiments. The media may also include, alone or in combination with the program instructions, data files, data structures, and the like. The program instructions recorded on the media may be those specially designed and constructed for the purposes of example embodiments, or they may be of the kind well-known and available to those having skill in the computer software arts. Examples of non-transitory computer-readable media include magnetic media such as hard disks, floppy disks, and magnetic tape; optical media such as CD-ROM discs, DVDs, and/or Blue-ray discs; magneto-optical media such as optical discs; and hardware devices that are specially configured to store and perform program instructions, such as read-only memory (ROM), random access memory (RAM), flash memory (e.g., USB flash drives, memory cards, memory sticks, etc.), and the like. Examples of program instructions include both machine code, such as produced by a compiler, and files containing higher level code that may be executed by the computer using an interpreter. The above-described devices may be configured to act as one or more software modules in order to perform the operations of the above-described example embodiments, or vice versa.

A number of example embodiments have been described above. Nevertheless, it should be understood that various modifications may be made to these example embodiments. For example, suitable results may be achieved if the described techniques are performed in a different order and/or if components in a described system, architecture, device, or circuit are combined in a different manner and/or replaced or supplemented by other components or their equivalents. Accordingly, other implementations are within the scope of the following claims.

What is claimed is:

1. A walking assist device comprising:

a sensor device including at least one sensor configured to sense physical information of a user, a support attached directly to a waist portion of a main frame of the walking assist device, the support configured to extend from the main frame, wherein the support does not directly contact a waist of the user, but indirectly contacts the waist of the user through the at least one sensor, and provide an elastic force to direct the at least one sensor toward the waist of the user, even when a gap between the waist portion of the main frame of the walking assist device and the waist of the user occurs, a slider between the at least one sensor and a rotator connected to the support, the slider configured to move the sensor translationally relative to the support, the slider configured to move along a first virtual axis, and the rotator between the slider and the support, the rotator configured to move the sensor and the slider rotationally relative to the support, the rotator configured to rotate about a second virtual axis vertical to the first virtual axis;

a processor configured to calculate a gait cycle of the user based on the sensed physical information, and calculate a torque corresponding to the calculated gait cycle; and a driver configured to output the torque based on the calculated torque.

2. The walking assist device of claim 1, wherein the sensor is an inertial measurement unit (IMU) configured to measure a posture of a body of the user to which the sensor is attached.

3. The walking assist device of claim 1, wherein the sensor is configured to sense biodata of a body of the user to which the sensor is attached.

4. The walking assist device of claim 1, wherein the processor is further configured to model a posture of the user based on the physical information and calculate the gait cycle based on the modeled posture.

5. The walking assist device of claim 1, wherein the at least one sensor includes a pressure sensor, the pressure sensor configured to measure a pressure applied to a body of the user by the torque output by the driver, and the processor is further configured to calculate a torque adjustment value based on the calculated gait cycle and the measured pressure and adjust the torque based on the calculated torque adjustment value.

6. The walking assist device of claim 1, wherein the support further comprises a pressure sensor configured to measure a pressure applied to a body of the user by the torque output by the driver using a load cell.

7. The walking assist device of claim 1, wherein the support extends upwards from the waist portion of the main frame.

8. The walking assist device of claim 1, wherein the support is configured to direct the at least one sensor toward a back of the user.

9. The walking assist device of claim 1, wherein the support includes a bottom portion, and wherein the support is attached to the waist portion of the main frame at the bottom portion of the support.

10. The walking assist device of claim 1, wherein the support comprises a leaf spring.

* * * * *